United States Patent [19]

Roth

[11] 4,089,527

[45] May 16, 1978

[54] BOARD GAME APPARATUS

[76] Inventor: Barry B. Roth, 1251 Commonwealth Ave., Allston, Mass. 02134

[21] Appl. No.: 666,223

[22] Filed: Mar. 11, 1976

[51] Int. Cl.[2] ..... A63F 3/00

[52] U.S. Cl. ..... 273/249; 273/273

[58] Field of Search ..... 273/134, 134 AD, 134 C, 273/134 D, 134 E, 134 AT, 134 BD, 134 ER

[56] References Cited

U.S. PATENT DOCUMENTS

| | | | |
|---|---|---|---|
| 1,559,954 | 11/1915 | Gifford | 273/134 B |
| 2,693,961 | 11/1954 | Ripley | 273/134 C |

*Primary Examiner*—Robert W. Michell
*Assistant Examiner*—Arthur S. Rose
*Attorney, Agent, or Firm*—Wolf, Greenfield & Sacks

[57] ABSTRACT

A game that is usually played by two to four persons and requires memorization, generally by association, of certain predetermined facts to be successful at winning. The game apparatus comprises a board which defines a playing field having marked squares defining a continuous path or course extending about the board, a plurality of numbered memory cards or a memory list, four colored playing pieces, a clock, dice, a deck of luck cards and a number of marker cubes. The board squares include numbered squares which carry written or graphic indicia and which correspond numerically to the memory cards, luck squares which are associated with the luck cards and opportunity squares. When a player lands on a square, the square is then his and is marked by one of his marker cubes. The opponents are given one minute to memorize the corresponding memory card, which provides assorted and variable information such as a state and its capitol and sometimes an illustration of the information. The information to be recalled may be memorized by association with indicia on the corresponding number square or may be memorized by association with the illustration (where provided) on the memory card. If an opponent thereafter lands in the controlled square the player who controls it can request that the opponent recall the information on the corresponding memory card and also one other memory card corresponding to another square controlled by the player. When memory cards have on them illustrations, a player asked to recall said card is allowed to see the illustration. Failure to recall on the part of any player requires that player to restart.

15 Claims, 5 Drawing Figures

BOARD GAME APPARATUS

BACKGROUND OF THE INVENTION

The present invention relates in general to a board game apparatus and is concerned more particularly with a board game played with a plurality of players which is both entertaining and educational and develops and improves one's powers of observation, concentration and memory.

Various types of board games exist such as the well known Monopoly game which is disclosed in U.S. Pat. No. 2,026,082. This game is primarily an entertainment game of barter and is more involved with an element of luck than skill. This prior art board game does not require any memorization.

Accordingly one object of the present invention is to provide a board game apparatus that is preferably played by two to four players and which is designed to aid and develop the memory by providing an environment for the practice of numerous memory techniques. There are many memory techniques for which the game is ideally suited to test and develop, among them, as examples being memory by association and word substitution.

Memory by association is a method of remembering wherein a story is created which links two otherwise unrelated data. When one of the data to be remembered is apparent, familiar or both, it makes recalling the unrelated data easier.

For example if a person needed to remember to take out a bank loan, they might envision one without "strings attached". They might actually picture themselves accepting a loan and cutting off some strings. The day on which they needed to take out a loan, they would tie a string around their finger. Later on during the course of a busy day seeing the string tied to their finger, would remind them about taking out the loan with no strings attached.

Another object of the present invention is to provide a board game apparatus which requires memorization and is easily adaptable to the memorization of a number of different types of information. For example, the game can be played using memory cards that show the presidents of the United States. With this game the participants may learn, not only the names of the presidents, but also the order in which they were president. The game may be provided with a number of different memory card decks. Other decks may contain for example the states and their capitals or the largest lakes in the world. Blank decks may be provided in which players may provide their own data in the necessary format. Concentration is developed by quick rewards for paying attention and penalties for not doing so. Players also develop powers of observation by studying illustrations provided on some sets of memory cards and associating them with the accompanying illustration.

SUMMARY OF THE INVENTION

To accomplish the foregoing and other objects of this invention the board game apparatus comprises a board having marked areas defining at least one path extending acout the board wherein one of the marked areas represents a starting area and there is also provided a winning area. There are a plurality of different playing pieces one for each player. For example, the game may be played by two to four players and the pieces may be distinguished by using different colors such as red, yellow, green and blue. Means are provided usable by each player in sequence for determining the number of areas that the respective player will move along the path. This means may comprise a conventional pair of dice which are rolled by each player in sequence. The marked areas may be referred to as marked squares including at least memory or numbered squares but preferably also luck squares and opportunity squares. These marked areas although referred to as squares need not have a square shape. The marked squares, or at least the memory of numbered squares are each numerically or alphabetically identified and contain graphic or written indicia. In the illustrated example set forth hereinafter there are 50 memory squares each of which is numbered, has a word associated therewith and also has a picture thereon. Means are also provided defining a plurality of different information indicia. This means may be in the form of a deck of memory cards or a memory list. When the cards are used a number of these cards are to be memorized during the course of the game. Each card is also numerically or alphabetically identified so that the information thereon corresponds to and may be associated to a particular marked area and in turn to the graphic or written indicia on the marked area. For example, the indicia on each card may represent one of the states of the United States and a picture on the card may show the location and shape of the state next to which may be the name of the state and its capital. The card also contains a numerical or alphabetical designation on one of the marked areas.

A plurality of markers are also provided and these markers are separated into sets corresponding to the number of playing pieces. In the previous example where the playing pieces are identified by different colors, similarly, the markers may be identified by the like colors. Thus, the "red" player is provided with a plurality of red markers. These markers are preferably red on one side and white on the other. In a preferred embodiment the marks are of cubic shape having red, yellow, green and blue surfaces and two oppositely disposed white surfaces. The apparatus of this gate also comprises a timing means for establishing a predetermined memorization time period. This timing means may simply be a 1 minute hour glass or could be a very simple mechanical timer.

Once an operating sequence has been determined each player in this sequence rolls the dice or in some other manner determines by chance the number of moves that the player is to take. When a player lands on a particular memory square the player claims control of that square by placing his or her marker on the memory square. If for example the player has a red playing piece then he turns the cube to its red surface; that surface facing upwardly to indicate that the particular memory square is his. The player occupying the memory square is then provided with the associated and similarly numbered card which card is shown to all other players who are required to memorize the information on the memory card. This information may be memorized by associating the information with the word or picture on the associated memory square of the board or may be recalled by association with the illustration (where provided) on the memory card. When illustrations are provided on the memory card, players are allowed to see then when asked to remember the information on a memory card. An opposing player; that is, one that did not land on the particular memory square, sets the 1 minute hour glass and the memory card is visible to all players for this 1 minute period of time. If on a subsequent move another player lands on a previously controlled memory square then the owning player may challenge the trespassing player and request that he recall the information on the memory card corresponding to the memory square and in one form of the invention may also request that the trespassing player also recall a memory card associated with another memory square also controlled by the owing player. This sequence of operation continues with each player moving his pieces about the board in sequence and with all players running the risk of landing on a memory square controlled by one of the other players and thereby having to recall at least one predetermined memory card. When a player is required to recall a memory card the sand clock may again be set for 1 minute and the player is provided that 1 minute time period within which to recall the contents of the particular memory card. If the memory card has an illustration on it, they may see the illustration. In one simplified form of the game the path of marked areas or squares is continuous and the game is completed or won by the first player to successfully complete the path and return to the starting square. Of course, when a player cannot recall the data on a corresponding memory card upon landing on a controlled square that player must then return to the starting square.

The marked areas on the board may also comprise, in addition to memory areas or squares, opportunity squares. Generally, there are far fewer numbers of opportunity squares provided on the board than memory squares. When a player lands on an opportunity square they may challenge any other player to identify at least one and preferably two of their own memory squares, or alternatively, they may acquire any two unclaimed memory squares upon which they then place their marker as represented by the proper colored surface of the marker cubes.

In a preferred form of the invention the marked squares are disposed about the outer edge of the board along a square locus having luck squares in each corner. Four chamber paths are provided extending from each luck square in the corner to the center of the board which is referred to as the throne; the object of the game being to sit upon the throne of memory which is in the center of the board. The chamber squares, which again need not have a square shape, are alternately colored red, yellow, green and blue with the exception of a last few number of the squares which are white and thus are neutral squares. The colors of the chamber squares correspond with the various players playing pieces and when a player lands on a colored square of another player's the player is considered as a trespasser.

As a player approaches the luck square just preceding the the start square, after having just about completed the path around the edge of the board they may feel that it is strategically advantageous for them to try to get to the memory throne. Accordingly they want to enter the chamber commencing at that luck square. They must announce before hand that they intend to do so, and they must use only a single dice. It is not necessary to land exactly on the luck square but once the player enters onto a chamber square all of that player's markers are turned to their white or neutral side thereby indicating that these markers now belong essentially to all players in the game. If another player who has not yet entered a chamber lands on a memory square which has a white marker, the player on the right of that player may challenge the player to recall one of his memory cards. The challenging player may ask the player who has landed on a white marker to recall the memory card associated with that marker or any other memory card corresponding to a square controlled by that player or corresponding to a square marked by a white marker.

As a player throws the dice and proceeds up the chamber squares to the throne, if the player lands upon the color of another player that other player may challenge the trespasser to identify say any two of their own memory squares including the white marked squares. Thus, a player once having entered a chamber gives up direct control of their former data, and may be asked to recall it when proceeding through a chamber or when forced out of a chamber and once again circling the board. If a challenged player answers incorrectly they return to the luck square at the entrance to the chamber. They then have to proceed around the board to at least the next luck square which represents the entrance to the next chamber where they may again attempt to make it to the center of the board (the memory throne) but again must give up control of any memory squares they have since gained control of. After the player has passed the colored squares and if on a white chamber square he is essentially safe but must then enter the throne on an exact roll of the dice. When the player reaches the throne the first to do so is declared the winner.

BRIEF DESCRIPTION OF THE DRAWINGS

Numerous other objects or features and advantages of the invention should now become apparent upon a reading of the following detailed description taken in conjunction with the accompanying drawings, in which.

DETAILED DESCRIPTION

Figure 1:
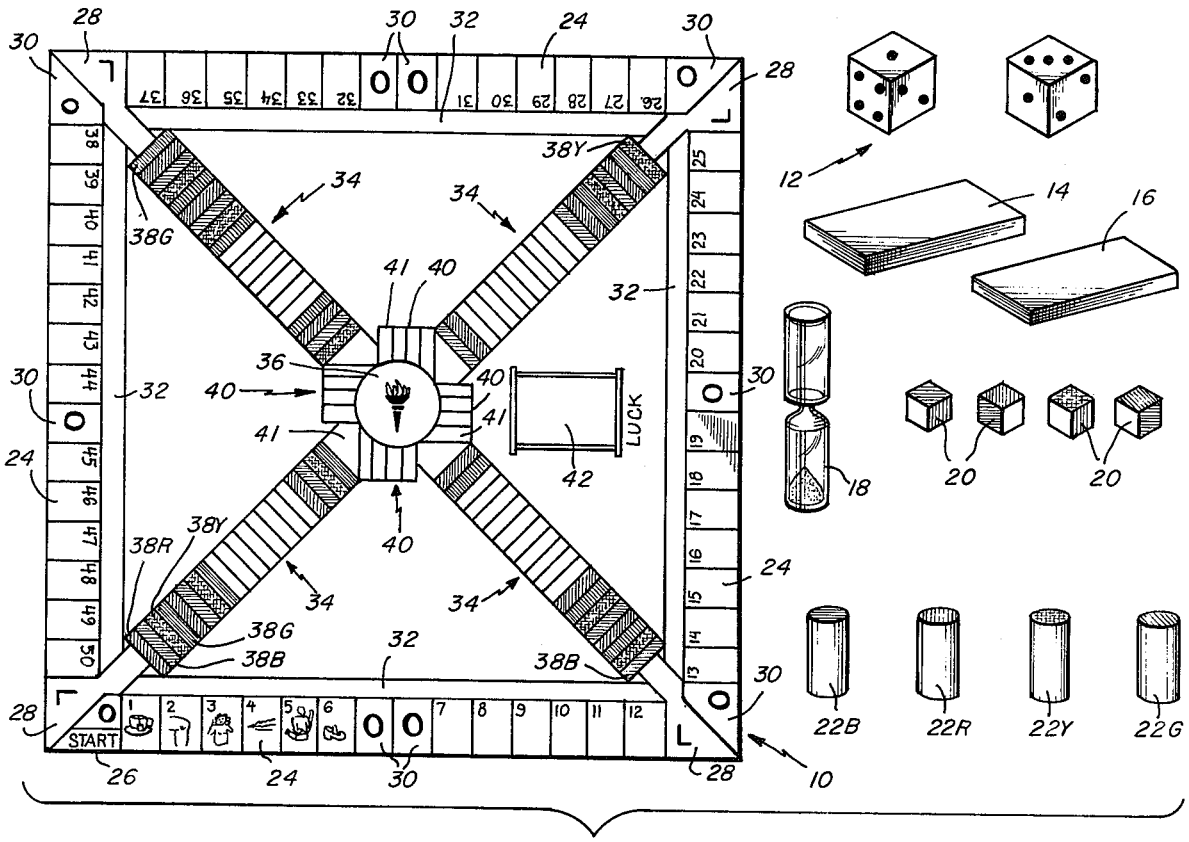
FIG. 1 shows a preferred embodiment of the apparatus of this invention including the board, memory cards, markers, and playing pieces.

The apparatus of the game is shown in a preferred form in FIG. 1. This apparatus comprises a playing board 10, a pair of dice 12, a stack of memory cards 14, a stack of luck cards 16, an hourglass timer 18, and a plurality of marker cubes 20. All of the marker cubes 20 may be identical in shape and each may have a different colored outer surface. For example, each cube preferably has opposite facing white surfaces with the other four surfaces being in order red, blue, green, and yellow. The actual order of the colors is not important. In an alternate arrangement each player may have his own colored markers having his color on one side and being white on the other side. However, it is preferred to use the cubic markers as there is no need then to differentiate between marker cubes. FIG. 1 also shows the playing pieces which are identified in accordance with their color as pieces 22B, 22R, 22Y, and 22G. The playing piece 22B may be blue or have a blue marking thereon, the piece 22R may be red or have a red marker thereon, etc.

Although it is preferred to use a pair of dice one could also use a simple spinner for selecting the number of steps that a player is to take. Also, rather than using a deck of memory cards a list carrying all of the information on the stack of cards could be used in its place. A one-minute hourglass may be used as a timer but in an alternate arrangement one could also use any other type of simple timer even one that is adjustable to provide different time periods.

Figure 2:
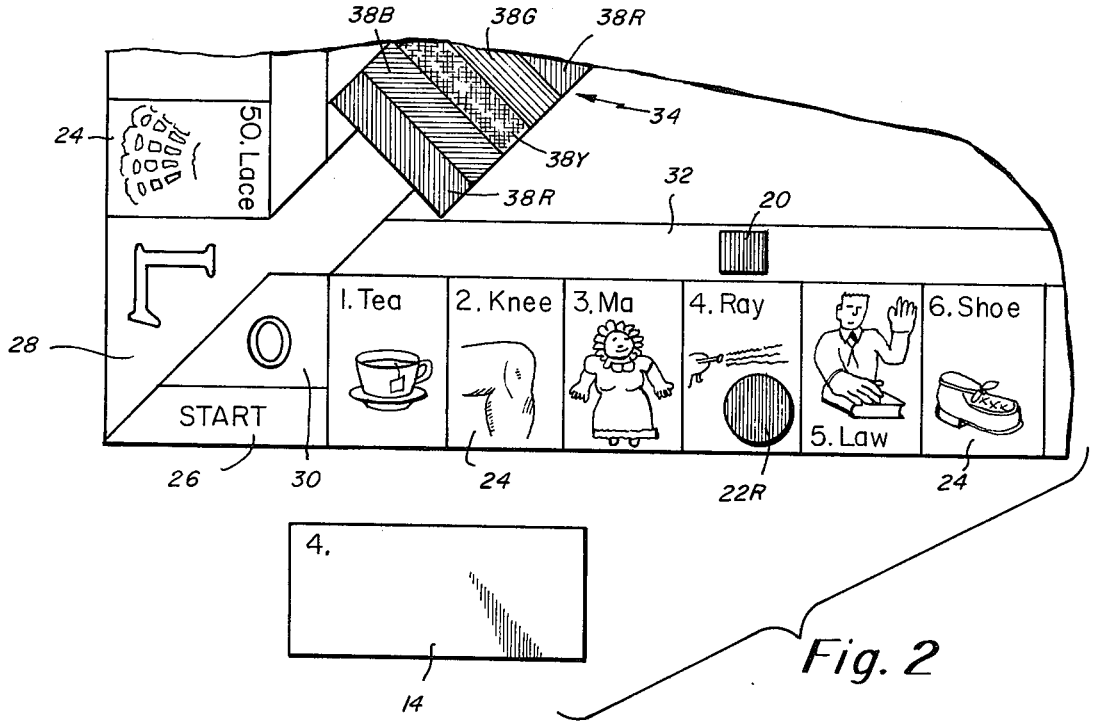
FIG. 2 is an enlarged view of a segment of the board about the starting square and showing a playing piece, a marker and an associated memory card.

The board 10 is separated into a number of spaces or what may be referred to herein as squares disposed about the edge of the board. Some of these squares are memory or hook squares and are consecutively numbered #1, #2, #3, #4, up to and including #50. Each of these memory squares also carries a word and a descriptive picture associated with the word. For example, in FIG. 2 square #1 has printed thereon the word "tea" and shows a cup of tea in this square. In addition to these memory squares 24 there is a start square 26, four luck squares and 10 opportunity squares 30 arranged in the pattern shown in FIG. 1 on the board 10. A border track extends about the board and provides a space adjacent each of the memory spaces 24 for accomodating a marker cube 20 as shown in FIG. 2.

The board 10 also defines four chambers which are additional paths for travel of the playing pieces to the final circular throne area 36. Each of the chambers 34 commences at a luck square 28 in the corner and each comprises a series of colored spaces including spaces 38R, 38B, 38Y, and 38G. The space 38R is red, the space 38B is blue, the space 38Y is yellow, and the space 38G is green. These colored spaces alternate in that sequence starting at the luck square 28 and terminating at the neutral area 40 which comprises five locations 41. The neutral area 40 bridges between the end of the colored spaces of chamber 34 and the winning throne area 36.

FIG. 1 also shows an area 42 at which there is located a deck of luck cards 16 the use of which will be explained in more detail hereinafter.

The winner of the game, as previously mentioned, is the person who can first reach or sit upon the throne area 36 which is at the center of the board. In order to do so the players start at the start square 26, completely encircle the board and enter the chamber 34 via the luck square 28 adjacent to the memory square #50. As a player travels about the board he is responsible for remembering certain information. If this information cannot be remembered the player may be required to return to the start square 26.

FIG. 1 shows a deck of memory cards 14. In an actual game there may be a number of different decks each having different topics. For example, one deck of cards may cover the 50 largest lakes of the world. Another deck may cover the states of the country and their capitals. Still another deck may cover the states of this country and their order of admittance into the country. Thus, one of the first steps in playing the game is to select a topic which may be a deck listing all of the states with their capitals. The important thing about the memory cards is that they have some way of corresponding to the memory squares on the board. For example a list could be made of memory cards, in which the order of appearance on the list indicates which memory square it corresesponds to, or they might have on them numbers to correspond to the memory square.

Sometimes the memory card will have only a word on them, which must of necessity be memorized by association with the corresponding memory square. At other times the memory card may come with an illustration of a word, or a portrait of a name. In this instance players might make observations of the illustration/portrait and associate this with the corresponding word/name. The amount of information to be recalled may be just one item or could be expanded to include a number of pieces of information. There are many combinations which this arrangement of data allows. The deck of luck cards 16 are then inserted in the space 42 on the board. Each player which may include two to four players selects a colored token or playing piece such as piece 22R shown in FIG. 2. Each player may be provided with a separate directory which is simply a sheet listing all of the memory squares 24 all on a separate sheet so that each player does not have to refer directly to the board when he is memorizing but may use the directory sheet. This sheet is not shown in the drawings and need not be a necessary part of the apparatus of the game. All of the playing pieces are placed on the start square 26. Each player then rolls the dice and the one who rolls the lowest number will be the first to start play. Play continues in the usual clockwise direction. Obviously, other ways may be devised for selecting the starting player such as the first player to roll a particular number on the dice. The same pair of dice are used by each player in sequence. Also, each of the players is provided with a number of marker cubes 20. Each player may be provided with, for example, 20 of these marker cubes.

FIGS. 2–5 show fragments of the board 10 with different playing conditions. As previously mentioned all of the players start with their pieces on the start square 26. FIG. 2 shows a time during playing when one of the players has rolled the dice presumably rolling a "four" so that his red piece 22R has landed on memory square #4. The "red" player thus controls this square and signifies his control by placing one of his marker cubes 20 with its red surface facing inwardly. The marker cube 20 is placed in the border track 32 as shown in FIG. 2. The corresponding #4 memory card 14 is then selected by the "red" player who now shows the information thereon to all other players. One of the other players then sets the hourglass 18 and the opposing players are given say one minute to remember the information on the #4 memory card. Actually, the "red" player should also memorize this data as it is possible that he may be required to recall the data on this card. Once having entered a chamber a player gives up direct control of all data they have acquired control over up to that time; consequently they may be asked to remember it when proceeding in the chamber 34 or when forced out and once again circling the board.

For example, information on the #4 memory card may show the state of Massachusetts with its geographical outline and also indicating that the capital of the state is Boston. To assist a player in memorizing the fact that square #4 corresponds to Massachusetts the player may associate the word "ray" and the picture of a ray gun with the state of Massachusetts. For example, the shape of the state with its extending Cape Cod may resemble a ray gun or one may associate by means of recalling that the word "ray" rhymes with the word "bay". Massachusetts is the Bay State. When illustrations are part of the particular memory card, players are normally allowed to see the illustration when asked to recall the data on the memory card.

Once the memorization time period has elapsed that card is concealed from all players. A player may examine any one of their squares, just before rolling the dice on their turn. This sequence of operation continues in turn by each player and each square 24 that is landed upon and that is unoccupied may be controlled by a player simply by placing the marker cube adjacent to the square in the border track 32 with the appropriate side facing upwardly so that the square is properly identified as being controlled by that particular player. Each timer that a player takes control of a square he must permit all other players including himself to view the correspondingly numbered memory card. Thus, each player accumulates control of a bank of memory cards as he progresses around the board.

If another player such as the "blue" player lands on a square controlled by another party such as memory square #4 control by the "red" player. The "red" player may challenge the "blue" player to identify the contents on the #4 memory card. In one version of the game the player landing on an opponents square may also have to identify the contents on another card associated with a square owned by the opponent.

If a player lands upon an opportunity square 30 they have two options open to them. The player landing on the opportunity square may challenge any other player to identify say any two memory squares owned by the player landing on the opportunity square. Alternatively, that player may select any two unclaimed memory squares. If the player exercises the latter option then the two memory cards associated with these selected squares must each in turn be shown to all other players so that they have an opportunity to memorize the contents thereof.

If a player lands on a luck square he may draw a luck card. These cards are self-explanatory. For example, one luck card may permit a player to have an extra turn or permit a player to obtain control of a particularly numbered square if it is not occupied. Also, the luck squares 28 serve as entrance ways to each of the chambers 34.

Figure 3:
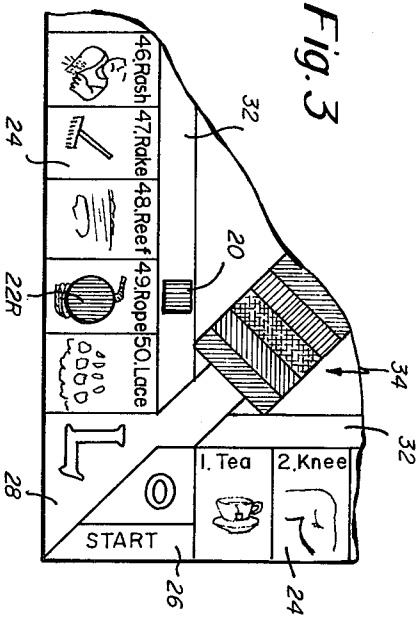
FIG. 3 is a view similar to that as shown in FIG. 2 showing the position of a player as represented by his playing piece after he has circled the board and is about to enter a chamber.

If a player is able to negotiate his way about the entire board he may come to a position such as shown in FIG. 3 where his playing piece 22R lands upon the memory square #49. As shown in FIG. 3 a marker 20 with its red surface facing upwardly is placed adjacent to this memory square on the board. When the "red" player again has his turn he is required to announce if he intends to enter the chamber 34 at the luck square 28 shown in FIG. 3. Once he makes this announcement he can no longer use two dice but must enter with the use of only a single dice. If he fails to make this announcement and rolls both dice then he must proceed along the outer edge of the board passing the luck square 28 shown in FIG. 3 and proceeding to the next luck square at the next corner where he can then enter the next chamber 34. Once the player such as the "red" player shown in FIG. 3 takes his turn and enters the chamber then all of his marker cubes 20 that are on the board are changed so that their white surface is facing upwardly. This means that once a player enters a chamber his marker pieces become the property of all players on the board and once having been in the chamber area he may even be required to remember the contents of a memory card previously controlled by him.

If another player who has not advanced as quickly and who is thus still travelling along the memory squares of the board lands on a memory square identified by the white marker cube the player to the right hand of that player may challenge the player landing on that square. The player to the right may consider all squares with white markings along with his own squares in challenging the player that has just landed on a square identified by a white marker cube.

The squares comprising the chamber 34 as previously mentioned are alternately colored. The colors are associated with the four possible playing pieces. When an opposing player lands on one of the squares of another he is considered a trespasser. The player whose playing piece matches the color of the square that the player has landed on may challenge the trespasser to identify, for example, any two of his memory squares including any white marked squares. It can be seen that if four players are playing then it is quite difficult to proceed through the chamber without landing on an opposing player's color. Once he lands on an opposing player's color that player can challenge him and the trespassing player may even be required to recall a memmory card previously controlled by him. If the challenged player answers incorrectly he must return to the luck square at the beginning of the chamber from where he entered. The player then must proceed around the board to at least the next luck square in sequence where if they feel it is strategically advantageous for them to again try to get to the memory throne at that time they may attempt to enter that chamber. As a player permanently gives up control over memory cards they've gotton control over before entering a chamber, they normally would consider the likelihood of succeeding in getting to the memory throne versus the disadvantage of losing control over the memory cards in making their decision to enter or not to enter a chamber.

Only a single dice is used by the player in the chamber area and in area 40. A player must enter the throne area 36 with an exact roll of the dice. The non-colored squares 41 at the end of the chamber are neutral squares and thus once a player enters this area he is in a fairly secure position. He must then only roll the exact number to enter area 36 and thus win the game.

Figure 4:
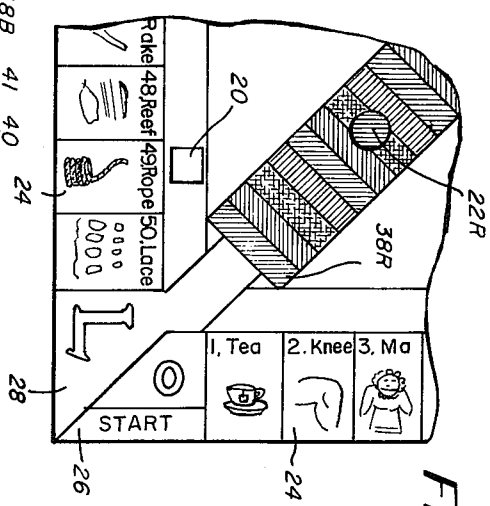
FIG. 4 is a view similar to that shown in FIG. 3 where the player has now entered the chamber.
Figure 5:
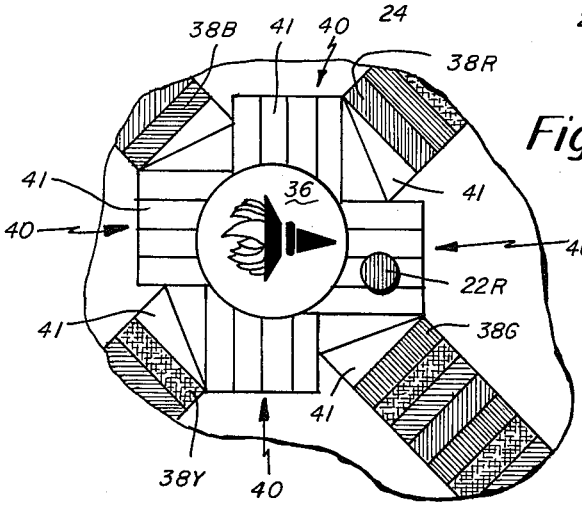
FIG. 5 is a fragmentary view of the board in the central area showing a playing piece entering the throne area and thus about to win the game.

FIG. 4 shows the playing piece 22R resting on an opponent's yellow square. FIG. 4 also shows the marking cube 20 as shown in FIG. 3 turned to its white side. FIG. 5 shows the piece 22R in the safe neutral area 40 about to enter the throne area 36.

Having described a preferred embodiment of the board game of this invention it should now beconme apparent that there are numerous modifications and different versions of the board game all of which are contemplated as falling within the scope of this invention. For example, in a simplified version possibly for use by young children the board may have only the outer edge path with the winner being determined simply by the first player to circle the board and land on the luck square 28 adjacent to the start square 26. In this version the luck square is actually the winning area. Different colors have been used for identification, however, one could also use different shapes for the playing pieces and different shapes in the chamber squares corresponding to different shaped playing pieces. The rules can be altered in many different ways such as, for example, by requiring that a trespassing player who lands on one of the memory squares identifies only the memory card associated with that square and no other memory cards. In another version of the game spaces 24 may carry only numbers or alternatively only letters. In addition, there are numerous other modifications in alternate versions of the game all of which are contemplated as falling within the spirit and scope of the present invention.

What is claimed is:

1. A board game apparatus comprising:

a board having marked areas defining a path delineated on the board, one of said marked areas representing a starting area, a plurality of differently identified playing pieces one for each player, means usable by a player for determining the number of areas that the respective players shall move along the path, said marked areas each being individually identified, means defining a plurality of different information indicia each of which has factual data thereon which is to be memorized, each said information indicia being identified to correspond to a marked area, a plurality of markers separated into sets corresponding to the number of playing pieces, said markers each being associated with the marked area where each piece has landed when moved and indicative of the control of that marked area, timing means capable repetitively of indicating the termination of a precise predetermined period of time only sufficiently long to enable a player to adequately memorize an information indicia that corresponds to the marked area upon which one of the players has landed, any one of said players when their piece lands on a marked area controlled by another player said another player may request that said any one player recall at least one of said information indicia means corresponding to a marked area controlled by said another player, said any one player being penalized upon failure to recall, said any one player being declared a winner after completing said path.

2. A board game apparatus as set forth in claim 1 wherein said marked areas are identified in numerical sequence with each area containing graphic or written patterns.

3. A board game apparatus as set forth in claim 2 wherein said means defining different information indicia includes cards each having information shown thereon and each identified numerically to correspond with a like numerically marked area.

4. A board game apparatus as set forth in claim 3 wherein the playing pieces are differently identified by color.

5. A board game apparatus as set forth in claim 1 wherein all markers in all sets are alike and each comprise a multi-surfaced marker having at least a white surface and at least two colored surfaces.

6. A board game apparatus as set forth in claim 5 wherein each marker is cubic having two opposing white surfaces and four differently colored surfaces.

7. A board game apparatus as set forth in claim 1 wherein said board further has marked areas defining another path extending from the end of the first path and terminating at a winning area.

8. A board game apparatus as set forth in claim 7 wherein the marked areas of the other path are identified in sequence in a like manner to the identification of the playing pieces with each player controling some of the marked areas irrespective of landing thereon and wherein an opposing player landing on a marked area of another player is required to recall at least one information indicia controlled by the other player.

9. A board game apparatus as set forth in claim 1 wherein said marked areas include memory areas and opportunity spaces.

10. A board game apparatus as set forth in claim 1 wherein said information indicia means has factual data thereon and each is identified numerically to correspond with a like numerically marked area.

11. A board game apparatus as set forth in claim 1 wherein the majority of said marked areas are memorization areas each having a unique figurative illustration thereon.

12. A board game apparatus as set forth in claim 11 wherein said information indicia means includes cards corresponding in number to said memorization areas.

13. A board game apparatus as set forth in claim 4 wherein said information indicia means defines a series of data fact means each identified alpha-numerically like said memorization areas.

14. A board game apparatus as set forth in claim 1 wherein said means defining different information indicia corresponding in number to memorization areas defined on the board and which comprise the majority of the marked areas on the board.

15. A board game apparatus as set forth in claim 14 wherein the memorization areas are alpha-numerically designated to correspond to similarly designated information indicia means.

* * * * *